United States Patent [19]

Mayer

[11] Patent Number: 4,488,532

[45] Date of Patent: Dec. 18, 1984

[54] GAS-DYNAMIC PRESSURE WAVE MACHINE WITH EXHAUST GAS BYPASS

[75] Inventor: Andreas Mayer, Niederrohrdorf, Switzerland

[73] Assignee: BBC Brown, Boveri & Company, Limited, Baden, Switzerland

[21] Appl. No.: 427,728

[22] Filed: Sep. 29, 1982

[30] Foreign Application Priority Data

Nov. 30, 1981 [CH] Switzerland ..... 7641/81

[51] Int. Cl.[3] ..... F02B 33/42

[52] U.S. Cl. ..... 123/559; 417/64

[58] Field of Search ..... 60/600, 601, 602, 603; 123/559, 564; 417/64

[56] References Cited

U.S. PATENT DOCUMENTS 1,508,707 9/1924 Moss ..... 60/600 X
2,800,120 7/1957 Jendrassik ..... 417/64 X

FOREIGN PATENT DOCUMENTS 14695 3/1919 United Kingdom ..... 123/564
291152 5/1928 United Kingdom ..... 123/564

OTHER PUBLICATIONS

BBC Publication No. CH-T 12 3063D, "Die Alternative Heisst Comprex", Jul. 16, 1979.

*Primary Examiner*—Michael Koczo
*Attorney, Agent, or Firm*—Oblon, Fisher, Spivak, McClelland & Maier

[57] ABSTRACT

A gas-dynamic pressure wave machine with an exhaust gas bypass (11) which includes a flap (12) provided in the bypass (11) which opens with higher engine speeds in order to limit the peak pressure in the internal combustion engine (9). A flap control is provided via a pressure box (14) with a process pressure, for example, exhaust gas pressure, as the controlling dimension. The process pressure is coupled with a constant pressure such as a vacuum or excess pressure for altitude compensation and temperature compensation in such a manner that the process pressure is to be raised by the same amount with a decreasing atmospheric pressure. For this purpose, the pressure box (14) is divided into first and second separate chambers (16, 17) by means of a diaphragm (15) and the process pressure acts on the first chamber while the second chamber is maintained under a constant pressure. The diaphragm (15) acts on the flap (12) through a plurality of rods (19–23).

2 Claims, 1 Drawing Figure

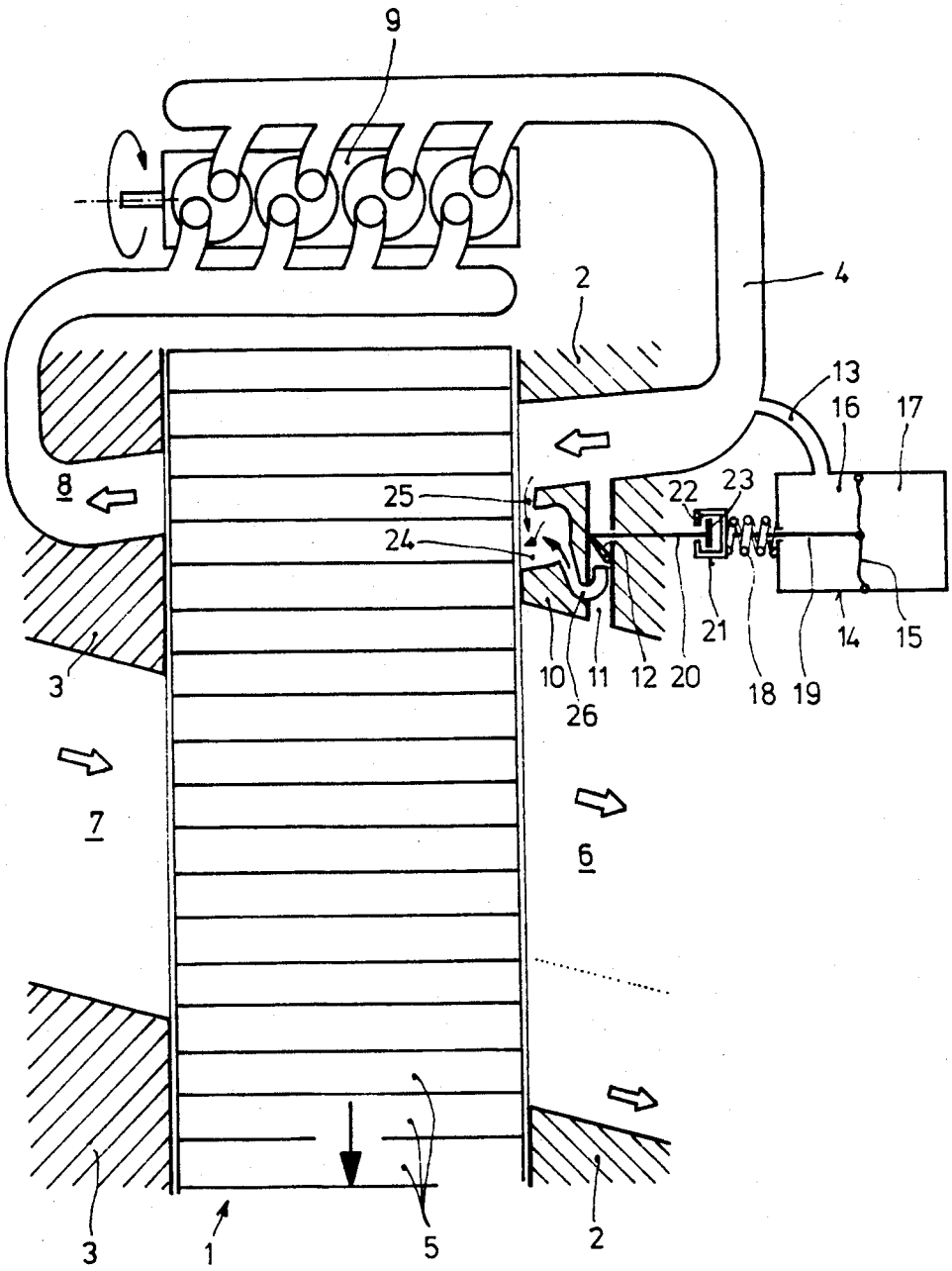
9
2
4
13
16
17
8
25
24
22
23
21
14
15
3
10
11
12
20
18
19
26
7
6
3
1
5
2

GAS-DYNAMIC PRESSURE WAVE MACHINE WITH EXHAUST GAS BYPASS

BACKGROUND OF THE INVENTION

1. Field of the Invention

This invention concerns a gas-dynamic pressure wave machine for the charging of an internal combustion engine in which, within the gas chamber, an exhaust gas bypass with a medium-controlled flap connects the high pressure gas supply duct with the low pressure gas escape duct.

2. Description of the Prior Art

The application of an exhaust gas bypass can be quite interesting in small engines for passenger cars being charged by means of pressure wave machines in which the peak pressure is limited and which have a wide speed range. Since such engines have an elastic torque which is characterized by flat pressure development across the entire engine speed range, on the one hand, in comparison with the exhaust gas turbocharging, less exhaust gas must be released into the exhaust pipe and, on the other hand, the release must only take place with higher engine speeds. Thus, the poorer specific fuel consumption caused by the non-utilized release occurs only in a narrow range which, according to experience, is a rare event in the case of passenger cars.

The control of the charged air pressure by a targeted release is known for a pressure wave machine as mentioned in the introduction from the British Pat. No. 775,271. When the exhaust gas pressure exceeds a predetermined value, a spring-loaded flap is opened which is arranged between the high pressure gas supply duct and the lower pressure gas escape duct in a bypass. A portion of the exhaust gas enters the exhaust pipe directly through this bypass without passing through the pressure wave process.

Since this known release control always operates only with a permanently set excess pressure even when driving uphill, the bypass is opened too early under these conditions so that the final pressure required for the acceleration processes is not reached with a rising level owing to the reduced air density.

SUMMARY OF THE INVENTION

The object of the invention is, therefore, based on the task of creating a supercharged pressure limiting device which is independent of atmospheric pressure.

The use of an actually known pressure box whose diaphragm is mechanically coupled with the flap to be actuated is to be considered as a particularly simple and inexpensive solution.

Similar pressure boxes for the actuation of a bypass valve are known in connection with turbo-superchargers (German Disclosure Publication 28 22 207). Due to the fact that, with the occurrence of the valve lift, the decisive control pressure prevails in the one chamber but a pressure prevails in the other chamber which can be atmospherically influenced, this arrangement is not suited for the performance of a level correction.

In order to recover the energy of the bypass flow, at least partially, in connection with pressure wave machines which have a gas pocket in the gas casing arranged in time after the high pressure gas supply opening in order to guarantee the low pressure cleansing (Publication No. CH-T 123 143 issued by the applicant), this gas pocket can be connected with the bypass. This connection is appropriately effected behind the flap.

When it is conceived as a wall bore hole reaching into the gas pocket, the gas pocket is acted upon by the static pressure of the bypass flow when the flap is open. A higher recovery is obtained due to the fact that the connection is designed as an open sampling tube directed into the core of the flow in the form of a flow probe.

BRIEF DESCRIPTION OF THE DRAWINGS

An exemplified embodiment of the invention is schematically shown in the drawing. The sole FIGURE shows a development of a cylinder section at half the height of the cells through the rotor and through subsequent parts of the lateral portion of the casing.

DETAILED DESCRIPTION OF THE PREFERRED EMBODIMENTS

The basic structure of a pressure wave machine and its exact design can be taken from the already mentioned publication CH-T 123 143. For reasons of simplicity, the pressure wave machine shown in the sole FIGURE is represented as a one-cycle machine which is expressed by the fact that the gas casing 2 and the air casing 3 are each provided with only one high pressure and one low pressure opening on their sides towards the rotor 1. In order to be able to explain the operation of the system more clearly, the directions of flow of the working media and the direction of rotation of the pressure wave machine are indicated by arrows.

The hot exhaust gases of the internal combustion engine 9 enter via supply duct 4 the rotor 1, which is provided with axially straight cells 5 open on both sides thereof, expand there and escape from it through the low pressure gas escape duct 6 into the exhaust pipe (not shown). Atmospheric fresh air is sucked in on the air side, flows axially into the rotor 1 through the low pressure air inlet duct 7, is compressed there and departs through the high pressure air outlet duct 8 towards the engine 9 as charged air.

In order to better understand the actual, extremely complex gas-dynamic pressure wave process which is not part of the object of the invention, attention is drawn to the already mentioned publication CH-T 123 143. The process development necessary for understanding the invention is briefly explained as follows. The row of cells 5 form a cylinder section of the rotor 1 which moves downward in the direction of the arrow upon rotation of the latter. The pressure wave processes occur in the interior of the rotor 1 and their effect is essentially that a gas-filled chamber and an air-filled chamber are formed. In the first chamber, the pressure of the exhaust gas is relieved and escapes into the low pressure gas escape duct 6 while, in the second chamber, a portion of the sucked-in fresh air is compressed and pushed out into the high pressure air outlet duct 8. The remaining portion of the fresh air is scavenged by the rotor into the low pressure gas escape duct 6 and thus effects the complete removal of the exhaust gases. This scavenging operation is essential for the development of the process and must be maintained under all circumstances. Care must be taken to avoid in any case exhaust gas remaining in the rotor 1 and being supplied with the charge air to the engine 9 in a subsequent cycle. Additionally, the scavenging air cools down the cell walls which have been greatly heated by the hot exhaust gases.

A bypass 11 with a medium-controlled flap 12 is arranged in a crosspiece 10 between the high pressure gas supply duct 4 and the low pressure gas escape duct 6 as is known from the British Pat. No. 775,271. This flap 12 is, in the present case, pivoted within the bypass 11 in a center of rotation (not shown). As the control medium for the flap actuation, high pressure gas is taken upstream from the pressure wave process through a pipe 13 and this acts upon a pressure box 14.

Pressure box 14 is divided into two chambers 16, 17 by means of a diaphragm 15. The diaphragm 15 interacts with a pressure spring 18 and is connected with the flap 12 through rods 19, 20. These elements are only represented in a schematic manner. The illustrated and below described configuration is, of course, not necessarily the most simple and most effective configuration. Rather, it has been set forth in order to explain the principle of the invention without leaving any misunderstandings.

In the initial situation, a constant pressure prevails in the chamber 17 which can either be a partial vacuum, a full vacuum or an excess pressure. In the balanced position of the diaphragm 15, i.e. when only atmospheric pressure prevails in the chamber 16, the bypass flap 12 is closed. During engine operation on a plane, for example, at sea level, the diaphragm 15 is moved towards the right against the effect of the spring with an increasing exhaust gas pressure. A very light spring 18 and only a slight counterpressure are assumed to be in the chamber 17 so that movement of the diaphragm starts at an early point in time. Under a predetermined gas pressure, the so-called response pressure, the cam surface 22 of the sleeve 21 arranged at the connecting rod 19 rests against the end face 23 of the connecting rod 20 leading to the flap 12. When the exhaust gas pressure continues to be increased by the rising engine speed and moves the diaphragm further towards the right, the bypass flap 12 is opened.

In higher altitudes, for example, when driving along roads over mountain passes, the performance of the engine is reduced due to the low air density. On the other hand, the exhaust gas temperature and smoke content increase. The altitude-related performance loss is compensated for to a large but insufficient degree through this rising exhaust gas temperature which improves the pressure wave process.

The use of a bypass adjustment system without altitude correction and dependent on the environmental pressure, as it is known from the German Publication 28 22 207, would then actually have a disadvantageous effect. With this known pressure box, the force in the valve closing direction is reduced owing to the low outside pressure whereby the bypass is opened at an even lower control pressure than during operation at sea level. This would lead to a lower supercharging pressure as well as to a performance drop as in the case of a pure suction engine.

The use of a pressure box according to the invention remedies this situation which will be explained first for a phase of operation wherein the bypass is closed. The low outside pressure at a certain altitude creates a new state of equilibrium by means of expansion of the chamber 17 and thus diaphragm movement toward the left. In this manner, the connecting rod 19 is shifted towards the left. In order to permit this movement with the flap 15 being closed anyway, the sleeve 21 of the diaphragm connecting rod 19 slides across the end face 23 of the flap connecting rod 20 without exerting any force.

When the engine is charged now, the increasing exhaust gas pressure will move the diaphragm 15 and the sleeve 21 towards the right without engaging the flap connecting rod 20. Even the exhaust gas pressure which opens already the flap at sea level is not sufficient to do so at a certain altitude. Only upon a further increase in the engine speed, and thus in the supercharged pressure or exhaust gas pressure, does the cam surface 22 come to rest against the end face 23. The then occurring lift of the connecting rod 20 actuates the flap in the opening direction.

The dimensioning of all participating elements is effected in such a manner that only real altitude compensation is performed. The order of magnitude of the shiftings is selected in such a fashion that the flap 12 always starts opening at the same absolute response pressure. When proceeding from sea level, this means that the decisive control pressure in the chamber 16 must be increased by the same amount by which the atmospheric pressure decreases with an increasing altitude in order to move the diaphragm 15 into the flap response position.

A further advantageous development of the invention is effected by connection of bypass 1 with a gas pocket 24 which is also arranged in the crosspiece 10 between the high pressure gas supply duct 4 and the low pressure gas escape duct 6 and is open towards the rotor 1. Depending on the design of the machine, such a gas pocket is indispensable in order to maintain scavenging—i.e. the complete removal of the expanded gases into the exhaust pipe—in the low pressure zone during each and every operational condition. This gas pocket receives high pressure exhaust gas energy through the opening 25 in the crosspiece 10 during operation with the bypass closed. This energy supply could shift the performance graph of the pressure wave machine and change the absorption capacity. During bypass operation, it may be found that the supply to the gas pocket of high pressure exhaust gas is insufficient which impairs the absolutely necessary low pressure scavenging.

At this point, the subject matter of the present invention comes into play due to the fact that, with the flap 12 being open, a correspondingly dimensioned portion of the bypass flow flows into a probe-like sampling tube 26 and is led into the gas pocket 24. From there, the energy-rich pocket content joins the already pressure-relieved gas in the cells 5 and there performs its function.

It goes without saying that the invention is not limited to what has been presented and described. In deviation from that, the charged air pressure or any other process pressure could be used as the control dimension instead of the exhaust gas pressure. Furthermore, the pressure box could be an actual pressure cylinder in which the described diaphragm is replaced by a piston moving back and forth. Also, when using a diaphragm, such could be simultaneously designed as a spring. Moreover, the use of a rubber sphere as a container for the constant pressure to be stored is contemplated. The constant pressure can, of course, also be varied for adjustment purposes and the corresponding chamber can then be provided with a valve, for example, a ball retaining valve.

In general, two basic possibilities are available for the selection of the constant pressure. When a high excess pressure is used for this purpose in the chamber 17 and a very light spring 18 is utilized, an interesting, progressive control pressure/lift function is obtained for the flap control. Other ideas are the basis of the application of a vacuum as the constant pressure and a strong spring 18. The characteristics of the spring are of decisive significance in this instance. A vacuum box is advantageous insofar as the temperature influence is eliminated which, depending on the arrangement of the pressure box, can develop in the hot engine room. In case of excess pressure boxes, these temperatures influence the pressure in the chamber 17 which, however, must be kept on a constant level.

Finally, the bypass 11 must not absolutely be arranged in the crosspiece 10 of the gas casing 2. It could as well be accomodated outside the pressure gas supply duct 4 or the low pressure gas escape duct 6, respectively.

What is claimed as new and desired to be secured by Letters Patent of the United States is:

1. A gas-dynamic pressure wave machine for the supercharging of an internal combustion engine comprising:

a rotor with axially straight cells open on both sides thereof;

a gas casing having a high-pressure gas supply duct and a low pressure gas escape duct formed therein;

exhaust gas bypass means located within said casing connecting the high-pressure gas supply duct with the low pressure gas escape duct and including medium-control flap means; and a gas pocket formed in said gas casing and which is open towards the rotor and located between the high pressure supply duct and the low pressure gas escape duct wherein said exhaust gas bypass means is connected with the gas pocket downstream of said flap means.

2. A gas-dynamic pressure wave machine according to claim 1, further comprising a sampling tube directed into the center of flow of the exhaust gas bypass means wherein said sampling tube interconnects said gas pocket with said exhaust gas bypass means.

* * * * *